US011332169B2

(12) United States Patent
Clavier

(10) Patent No.: US 11,332,169 B2
(45) Date of Patent: May 17, 2022

(54) RAILWAY VEHICLE AND ASSOCIATED TRAFFIC METHOD

(71) Applicant: ALSTOM Transport Technologies, Saint-Ouen (FR)

(72) Inventor: Jérémy Clavier, Le Creusot (FR)

(73) Assignee: ALSTOM Transport Technologies, Saint-Ouen (FR)

( * ) Notice: Subject to any disclaimer, the term of this patent is extended or adjusted under 35 U.S.C. 154(b) by 328 days.

(21) Appl. No.: 16/384,671

(22) Filed: Apr. 15, 2019

(65) Prior Publication Data

US 2019/0315381 A1 Oct. 17, 2019

(30) Foreign Application Priority Data

Apr. 17, 2018 (FR) ..... 18 53342

(51) Int. Cl.
*B61F 5/22* (2006.01)
*B61F 1/14* (2006.01)
(Continued)

(52) U.S. Cl.
CPC ..... *B61F 5/22* (2013.01); *B61F 1/14* (2013.01); *B61F 5/06* (2013.01); *B61F 5/245* (2013.01)

(58) Field of Classification Search
CPC .. B61F 5/245; B61F 1/14; B61F 5/122; B61F 5/06; B61F 5/00; B61F 5/02; B61F 5/04;
(Continued)

(56) References Cited

U.S. PATENT DOCUMENTS 1,347,898 A * 7/1920 Eaton ..... B61F 5/16 105/199.1
5,890,433 A * 4/1999 Wicks ..... B61F 3/125 105/4.2
(Continued)

FOREIGN PATENT DOCUMENTS

CN 104527717 A 4/2015
DE 102015013605 A1 4/2017
(Continued)

OTHER PUBLICATIONS

Search Report for FR Application No. FR1853342, dated Dec. 20, 2018 in 2 pages.

*Primary Examiner* — Zachary L Kuhfuss
*Assistant Examiner* — Cheng Lin
(74) *Attorney, Agent, or Firm* — Knobbe, Martens, Olson & Bear, LLP

(57) ABSTRACT

The invention relates to a railway vehicle comprising a car (14) and a bogie (16). The bogie (14) comprises a chassis (28) and a secondary suspension system (30). The secondary suspension system (30) comprises:
a set (34) of springs;
a jack (36) comprising two ends (44, 46); and
a supply device (38) of the jack (36).
The jack (36) is configured to go from a first so-called retracted configuration in which the jack (36) is only connected to the car (14) by the first end (44) to a second so-called deployed configuration in which the jack (36) is also connected to the chassis (18) by the second end (16). The power supply device (38) is configured, in the deployed configuration, to supply the jack (36) so as to move the car (14) away from the chassis (28) or to keep the distance between the car (14) and the chassis (28) constant.

8 Claims, 3 Drawing Sheets

(51) Int. Cl.
*B61F 5/24* (2006.01)
*B61F 5/06* (2006.01)

(58) Field of Classification Search
CPC ..... B61F 5/12; B61F 5/14; B61F 5/16; B61F 5/20; B61F 5/24; B61F 5/34; B61F 5/22; B61F 5/10
USPC ..... 105/198.2–198.5, 199.2, 200–203
See application file for complete search history.

(56) References Cited

U.S. PATENT DOCUMENTS

| | | | | |
|---|---|---|---|---|
| 6,637,348 | B1 | 10/2003 | Teichmann et al. | |
| 10,442,448 | B2 * | 10/2019 | Monette | B61F 5/06 |
| 2004/0016361 | A1 * | 1/2004 | Teichmann | B61D 47/00 105/164 |
| 2008/0210119 | A1 * | 9/2008 | Lehmair | B61D 47/00 105/199.3 |
| 2017/0355386 | A1 * | 12/2017 | Dausoa | B61F 5/16 |

FOREIGN PATENT DOCUMENTS

| | | | |
|---|---|---|---|
| EP | 3254924 | A1 | 12/2017 |
| WO | 2006/111398 | A1 | 10/2006 |

* cited by examiner

RAILWAY VEHICLE AND ASSOCIATED TRAFFIC METHOD

FIELD

The present invention relates to a railway vehicle comprising at least one car and at least one bogie carrying the car, the bogie comprising a chassis and a secondary suspension system between the chassis and the car, the secondary suspension system comprising a set of springs mounted between the chassis and the car, a jack comprising two ends extending along a same axis and a supply system of the jack.

BACKGROUND

In order to facilitate the embarking and disembarking of persons and/or goods, it is advantageous to be able to adjust the height of the car, in order to adapt it to that of the platform when the railway vehicle is at a station.

Document US 2004/0016361 describes a railway vehicle comprising a car, a bogie and a suspension system comprising a suspension spring and a jack in parallel extending between the car and the bogie. The jack makes it possible to vary the distance between the bogie and the car, the height of the car thus being variable. This in particular makes it possible to reduce the vertical distance between the floor of the car and a platform.

However, this system is not fully satisfactory. Indeed, when the railway vehicle is in motion, the jack and, in particular, the seals of the jack experience significant transverse forces due to the relative transverse movements of the car and the bogie. This can lead to premature wear of the jack and oil leaks. Furthermore, the presence of the jack mechanically connecting the car and the bogie increases the stiffness of the system, thus deteriorating the vertical damping between the car and the bogie.

SUMMARY OF THE INVENTION

The invention in particular aims to resolve these drawbacks by proposing a railway vehicle comprising a leveling system experiencing limited transverse forces and not adding additional stiffness to the suspension system.

To that end, the invention in particular relates to a railway vehicle of the aforementioned type, wherein the jack is configured to go from a first so-called retracted configuration in which the jack is only connected to the car by the first end of the jack, to a second so-called deployed configuration in which the jack is also connected to the chassis by the second end of the jack, the power supply device being configured, in the deployed configuration, to supply the jack so as to move the car away from the chassis or to keep the distance between the car and the chassis constant.

The jack is thus able to bring the car and the chassis to, then keep them at, a constant distance, for example chosen so that the height from the floor of the car when stopped at a station is substantially equal to the height of the platform of that station. When the railway vehicle is in motion between two stations, the second end of the jack is free, the jack thus not undergoing transverse forces due to the relative movements between the car and the bogie and substantially not adding additional stiffness to the secondary suspension system.

A railway vehicle according to the invention may further include one or more of the following features, considered alone or according to all technically possible combinations.

- the first end of the jack is connected to the car by a knuckle joint-type connection;
- the railway vehicle also comprises a blocking system configured to immobilize the jack relative to the car when the jack is in the retracted configuration and to leave the jack rotatable around the knuckle joint when the jack is in the deployed configuration;
- the blocking system comprises:
  - an upper cylinder fastened on the upper part of the jack, the first end of the jack being able to slide in the upper cylinder;
  - at least one converging wall protruding from the car and defining a cavity, the knuckle joint being situated in said cavity;
  - a protuberance protruding transversely from the upper cylinder and having a shape substantially complementary to the wall, the protuberance being situated in the cavity;
  - at least one blocking spring situated between the protuberance and the car, each blocking spring being able to go from a first idle position in which the protuberance cooperates with the wall when the jack is in the retracted configuration, to a second compressed position in which the protuberance is separated from the wall when the jack is in the deployed configuration;

- the protuberance has a substantially frustoconical shape;
- the jack comprises a cylinder and a piston separating the cylinder into an upper chamber and a lower chamber, and in that the power supply device of the jack is configured to supply, in the deployed position, only one of the upper and lower chambers in order to move the car away from the chassis or keep the distance between the car and the chassis constant;
- the other of the upper and lower chambers is equipped with a return spring that constrains the jack toward the retracted configuration;
- the railway vehicle further comprises a connection arranged between the car and the chassis and configured to limit the separation between the car and the chassis;
- the railway vehicle comprises four jacks situated in the four corners of the chassis.

The invention also relates to a traffic method of a railway vehicle as previously defined, comprising the following steps:

- travel of the railway vehicle, the jack being in the retracted configuration;
- stopping of the railway vehicle at a platform, the jack being in the deployed configuration and powered by the power supply device, so as to move the car away from the chassis or to keep the distance between the car and the chassis constant.

BRIEF DESCRIPTION OF THE DRAWINGS

The invention will be better understood using the following description, provided solely as an example and done in reference to the appended figures, in which.

DETAILED DESCRIPTION

The terms "vertical" and "horizontal" are to be understood generally relative to the typical directions of a railway vehicle running on horizontal rails.

Figure 1:
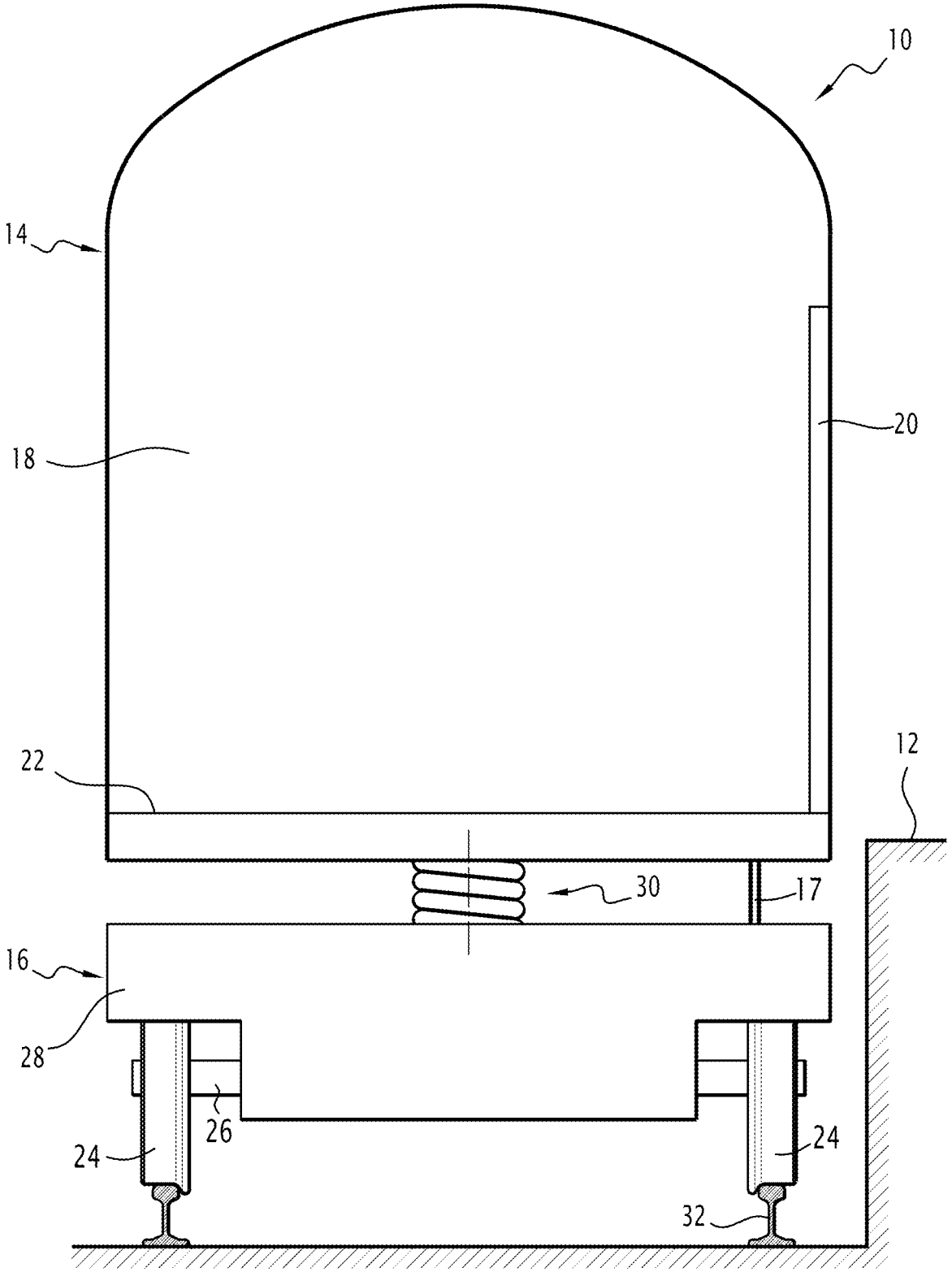
FIG. 1 is a schematic sectional view of a railway vehicle according to the invention, stopped at a station.

A railway vehicle 10 stopped at a station is shown in FIG. 1.

The station comprises at least one platform 12, such that the railway vehicle 10 is stopped along the platform 12.

The railway vehicle 10 comprises at least one car 14, at least one bogie 16 carrying the car 14 and, advantageously, a connection 17 arranged between the car 14 and the bogie 16.

The car 14 has an inner volume 18 configured to receive passengers and/or goods to be transported. The inner volume 18 communicates with the outside via at least one door 20. The inner volume 18 is in particular defined by a lower floor 22, on which the passengers and/or goods move.

The bogie 16 for example extends at one end of the car 14 and supports two adjacent cars 14 when the railway vehicle 10 comprises several cars 14. According to one conventional embodiment, the or each car 14 is supported by two bogies 16 at each of its ends.

The bogie 16 comprises wheels 24 mounted rotating on the bogie 16 by axles 26, a chassis 28 and a secondary suspension system 30 arranged between the chassis 28 and the car 14.

The wheels 24 are configured to roll on rails 32 and thus to allow the movement of the railway vehicle 10.

In one advantageous embodiment, the bogie 16 comprises four secondary suspension systems 30, located in the four corners of the bogie 16, the bogie 16 having a substantially rectangular cross-section. The term "transverse" is defined generally relative to a direction substantially orthogonal to the movement direction of the railway vehicle 10.

The secondary suspension system 30 extends along a main axis X extending along an elevation direction, for example substantially vertical when the railway vehicle 10 moves on horizontal rails 32. The terms "lower" and "upper" are defined relative to the elevation direction.

The secondary suspension system 30 makes it possible to react the movements along the elevation direction between the car 14 and the bogie 16. The secondary suspension system 30 in particular makes it possible to perform both the suspension function between the car 14 and the bogie 16 and the positioning function along the elevation direction of the car 14 relative to the train station platform 12.

Figure 3:
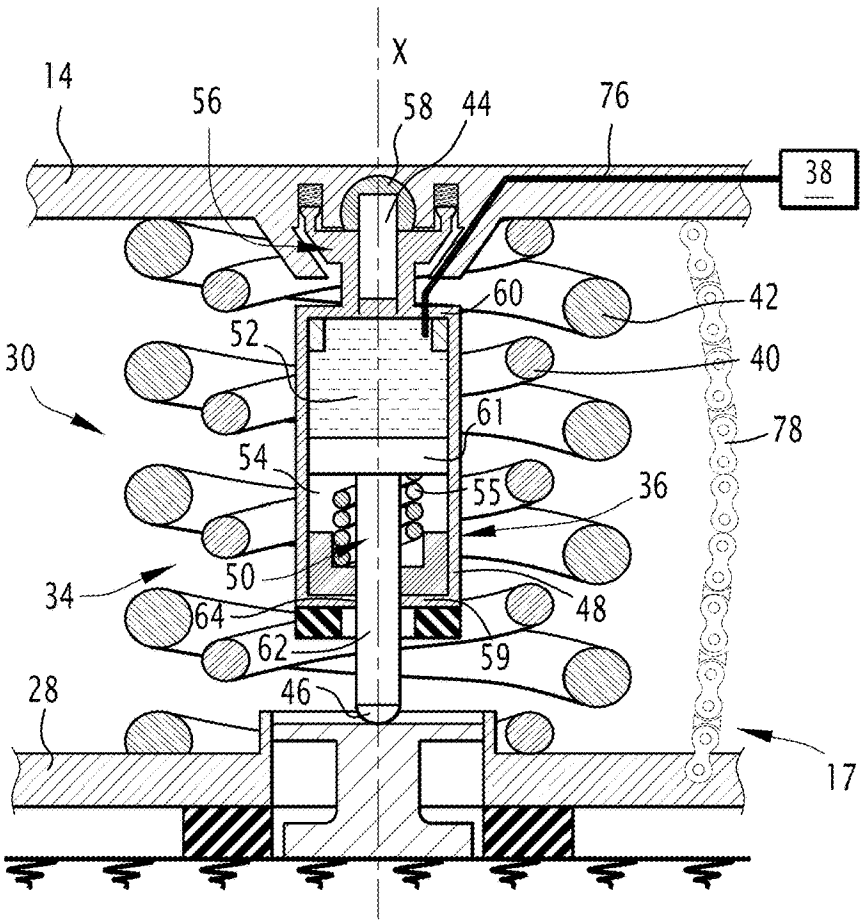
FIG. 3 is a schematic sectional view, along a vertical plane, of a secondary suspension system of a railway vehicle according to the invention, the jack being in the deployed configuration.
Figure 2:
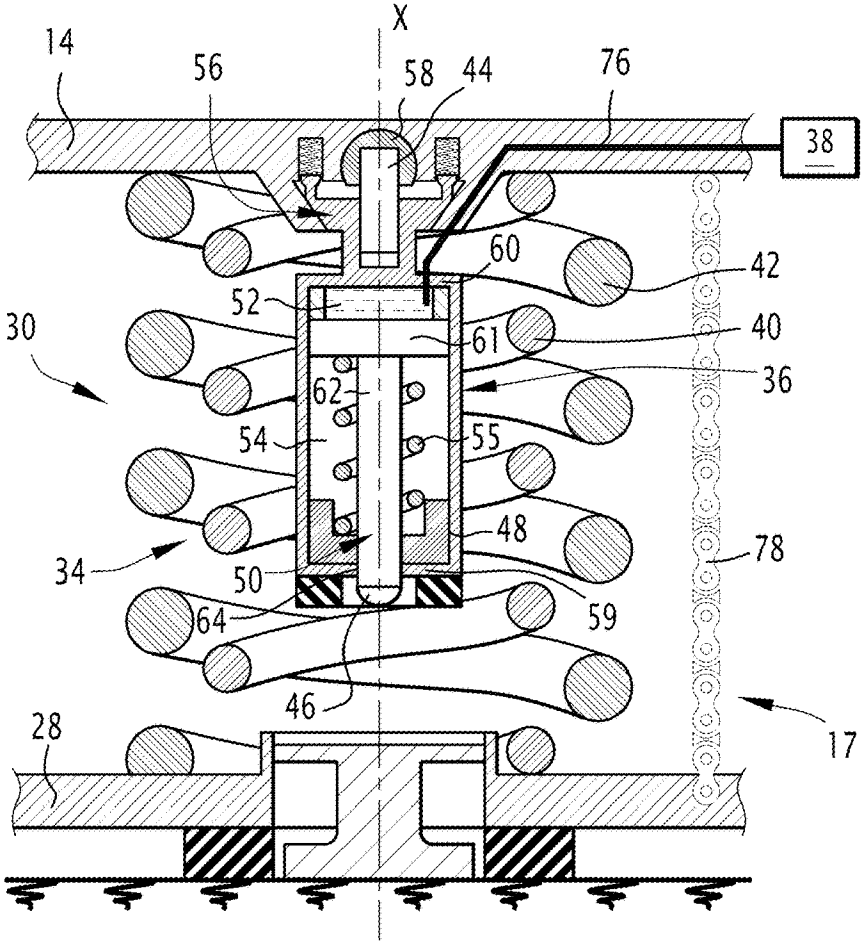
FIG. 2 is a schematic sectional view, along a vertical plane, of a secondary suspension system of a railway vehicle according to the invention, the jack being in the retracted configuration.

To that end, the secondary suspension system 30, shown in FIGS. 2 and 3, comprises a spring assembly 34 mounted between the chassis 28 and the car 14, a jack 36 and a power supply device 38 of the jack 36.

According to the embodiment shown in FIGS. 2 and 3, the spring assembly 34 comprises at least an inner spring 40 and an outer spring 42.

The inner spring 40 and the outer spring 42 are helical and coaxial springs, having the main axis X as central axis.

They each extend between the chassis 28 and the car 14. They are further secured to the chassis 28 and the car 14.

The diameter of the inner spring 40 is smaller than the diameter of the outer spring 42, such that the inner spring 40 extends in the inner volume defined by the outer spring 42.

Advantageously, the inner spring 40 and the outer spring 42 wind around the jack 36. The inner spring 40 and the outer spring 42 for example have opposite winding directions.

The spring assembly 34 allows a relative movement in the elevation direction between the chassis 28 and the car 14.

The jack 36 performs a positioning function of the car 14 relative to the bogie 16 in the elevation direction.

The jack 36 extends along the main axis X. The jack 36 comprises a first end 44 and a second end 46 that are substantially aligned along the main axis X. The jack 36 further comprises a cylinder 48, a piston 50 separating the cylinder 48 into an upper chamber 52 and a lower chamber 54.

In one advantageous embodiment, the jack 36 further comprises a blocking system 56 connected to the first end 44.

The first end 44 of the jack 36 is mechanically connected to the car 14. In one advantageous embodiment, the connection between the first end 44 and the car 14 is a knuckle joint 58 allowing the jack 36 to be rotatable in all directions around the knuckle joint 58 relative to the car 14.

The second end 46 is configured to extend between a so-called free position in which the second end 46 is mechanically free, the jack 36 then being said to be in the retracted configuration, and a so-called fixed position in which the second end 46 is in contact with the chassis 28, the jack 36 then being said to be in the deployed configuration.

In the retracted configuration, the jack 36 is only connected to the car 14 by the first end 44, as illustrated in FIG. 2.

In the deployed configuration, the jack 36 is connected to the car 14 by the first end 44 and to the chassis 28 by the second end 46, as illustrated in FIG. 3. The second end 46 is then able to exert pressure along the main axis X on the chassis 28.

The first end 44 and the second end 46 are located outside the cylinder 48, the cylinder 48 being located between the first end 44 and the second end 46 along the main axis X.

The cylinder 48 extends along the main axis X between a lower part 59 and an upper part 60.

The piston 50 is movable in the cylinder 48 and comprises a head 61 and a rod 62 secured to the head 61.

The head 61 is able to slide in the cylinder 48 along the main axis X, between the lower part 59 and the upper part 60.

The head 61 separates the cylinder 48 into two chambers hermetically separated from one another, i.e., the upper chamber 52 and the lower chamber 54.

The rod 62 hermetically passes through the lower part 59 of the cylinder 48 along the main axis X at a passage orifice 64. The rod 62 comprises the second end 46. The second end 46 is located opposite the head 61 relative to the main axis X.

According to one embodiment, the jack 36 further advantageously comprises at least one return spring 55. The return spring 55 is inserted in the cylinder 48. The return spring 55 is a helical spring having, as central axis, the main axis X.

The return spring 55 is configured to constrain the jack 36 toward the retracted configuration.

In the example illustrated in FIG. 2, the return spring 55 is situated in the lower chamber 54 and connects the head 61 to the lower part 59 of the cylinder 48. The return spring 55 constraints the head 61 toward a position separated from the lower part 59 of the cylinder 48. The rod 62 is advantageously inserted in the return spring 55, which limits the bulk of the jack 36.

Figure 4:
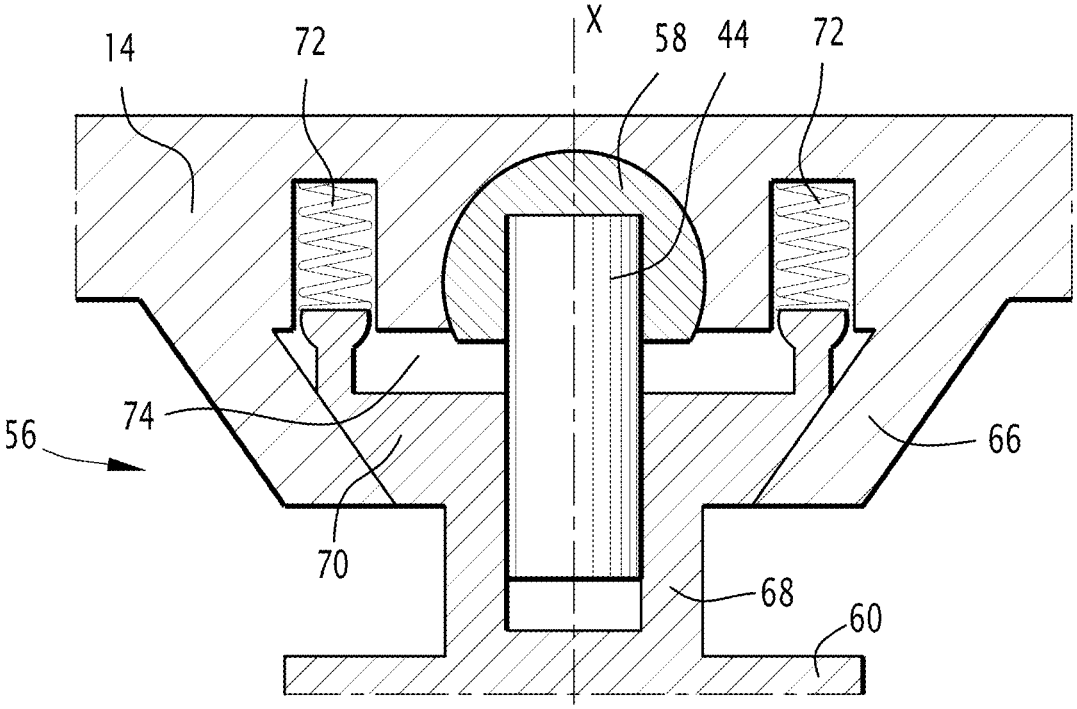
FIG. 4 is a schematic sectional view, along a vertical plane, of a blocking system of a railway vehicle according to the invention, the jack being in the retracted configuration.
Figure 5:
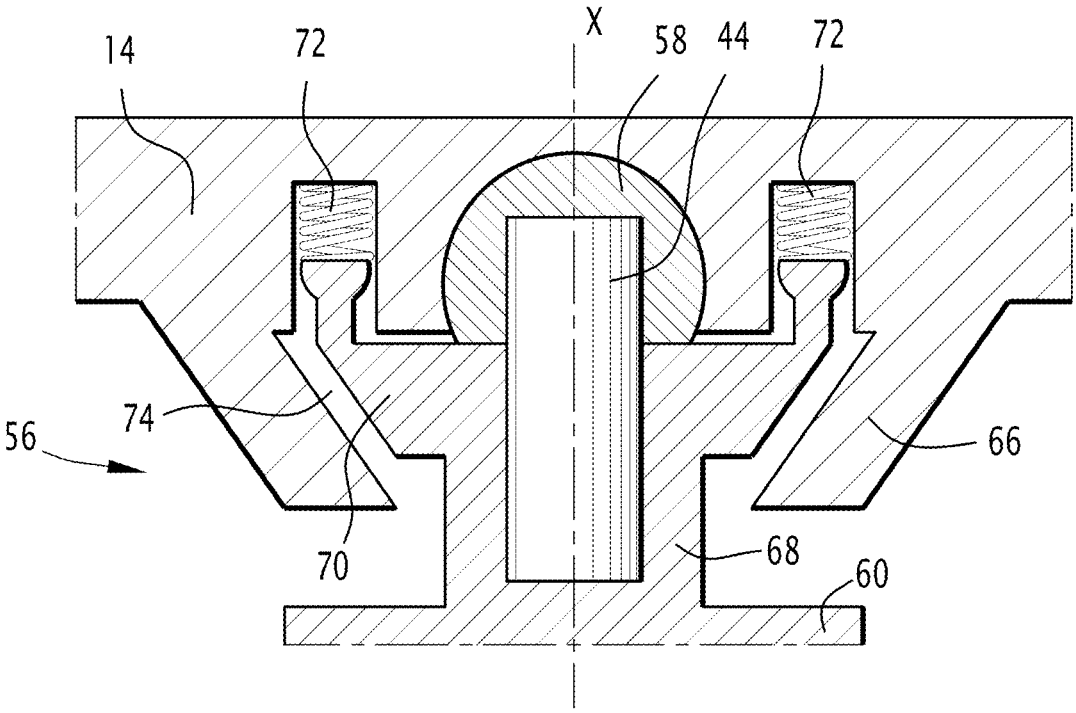
FIG. 5 is a schematic sectional view, along a vertical plane, of a blocking system of a railway vehicle according to the invention, the jack being in the deployed configuration.

In one advantageous embodiment, the blocking system 56 is situated between the first end 44 and the cylinder 48, as illustrated in FIGS. 4 and 5.

The blocking system 56 is configured to immobilize the jack 36 relative to the car 14 when the jack 36 is in the retracted configuration, as illustrated in FIG. 4.

In the retracted configuration, the jack 36 only being fastened by the first end 44 to the car 14, the blocking system 56 thus fastens the jack 36 relative to the car 14. This makes it possible to prevent the jack 36 from oscillating freely around the knuckle joint 58 and coming into contact with the set 34 of springs, which could cause rapid deterioration of the jack 36 and the set 34 of springs.

The blocking system 56 is further configured to leave the jack 36 rotatable around the knuckle joint 58 when the jack 36 is in the deployed configuration, as illustrated in FIG. 5.

In the deployed configuration, the jack 36 being connected to the car 14 and the chassis 28, the jack 36 is able to move away from the direction of the main axis X due to any relative transverse movements between the car 14 and the bogie 16. The jack 36 being rotatable around the knuckle joint 58, the jack 36 does not undergo transverse forces due to these relative movements between the car 14 and the bogie 16.

Furthermore, the jack 36 does not add additional stiffness to the secondary suspension system 30.

The blocking system 56 for example comprises at least one wall 66, an upper cylinder 68, a protuberance 70 and at least one blocking spring 72.

The wall 66 protrudes from the outer face of the floor of the car 14 toward the bogie 16. The wall 66 is convergent, substantially toward the main axis X.

The wall 66 defines a cavity 74 open along the main axis X at the lower end of the wall 66.

The knuckle joint 58 is situated in the cavity 74.

The upper cylinder 68 protrudes from the upper part 60 of the cylinder 48 toward the main axis X. The diameter of the upper cylinder 68 is advantageously smaller than the diameter of the cylinder 48.

The upper cylinder 68 is inserted partially into the cavity 74.

The first end 44 is received in the upper cylinder 68. The first end 44 is able to slide in the upper cylinder 68 along the main axis X. Thus, the first end 44 is connected to the cylinder 48 via the blocking system 56.

The protuberance 70 protrudes from the upper cylinder 68 transversely, along an axis substantially orthogonal to the main axis X.

The protuberance 70 has a shape complementary to the wall 66. Advantageously, the protuberance 70 is frustoconical, which allows easy cooperation between the protuberance 70 and the wall 66.

The protuberance 70 is situated in the cavity 74.

The blocking system 56 advantageously comprises a plurality of blocking springs 72.

Each blocking spring 72 extends substantially along the main axis X.

The blocking spring 72 is connected to the car 14 and the protuberance 70.

The blocking spring 72 is configured to go from a first idle position to a second compressed position, the distance between the protuberance 70 and the car 14 being smaller in the compressed position relative to the idle position. The blocking spring 72 constraints the protuberance 70 toward the idle position.

When the jack 36 is in the retracted configuration, the protuberance 70 cooperates with the wall 66 and rests bearing on it, due to the gravity exerted on the jack 36, as illustrated in FIGS. 2 and 4.

The blocking spring 72 is then in the idle position.

The blocking spring 72 is then configured to keep the protuberance 70 in contact with the wall 66 and thus to immobilize the jack 36 relative to the car 14.

When the jack 36 is in the deployed configuration, the protuberance 70 is moved away from the wall 66, as illustrated in FIGS. 3 and 5.

The first end of the jack 36 is then only connected to the car 14 by the knuckle joint 58. The jack 36 is then rotatable around the knuckle joint 58.

The power supply device 38 is able to supply the jack 36 with fluid, for example oil, here at a pressure comprised between 50 bars and 150 bars.

The power supply device 38 is configured to control the movement of the piston 50 in the cylinder 48, when the jack 36 is in the deployed configuration.

The power supply device 38 is in particular configured to control the movement of the piston 50 by supplying one of the upper 52 and lower 54 chambers in order to increase the volume thereof, which makes it possible to move the piston 50.

The return spring 55 is placed in the other of the upper 52 and lower 54 chambers not supplied by the power supply system 38.

In the example illustrated in FIGS. 2 and 3, the power supply system 38 supplies the upper chamber 52 and the spring 55 is placed in the lower chamber 54.

When the jack 36 is in the deployed configuration, the power supply system 38 is then able to fill the upper chamber 52 in order to increase the volume thereof so as to move the piston 50 in a direction in which the piston 50 moves away from the car 14. The power supply system 38 is therefore able to increase the distance between the car 14 and the chassis 28.

The connection 17 is a long and flexible body connecting the car 14 and the chassis 28. The connection 17 is advantageously a metal chain comprising an assembly of links 78. The connection 17 is configured to limit the separation between the car 14 and the chassis 28 in order to prevent the impact of the piston 50 against the lower part 59 of the cylinder 48, repeated impacts being able to lead to damage of the jack 36. In other words, the connection 17 is tensed, and therefore prevents any additional movement of the car 14 relative to the chassis 28, before the piston 50 comes into contact with the lower part 59 of the cylinder 48.

When the jack 36 is in the deployed configuration, the power supply system 38 is further able to impose a pressure in the upper chamber 52 so as to keep the piston 50 in a desired constant position in the cylinder 48. The power supply system 38 is therefore able to keep the distance constant between the car 14 and the chassis 28.

The power supply device 38 for example comprises and accumulator and a reservoir (not shown) positioned at the car 14 and a supply duct 76 configured to supply fluid to the upper chamber 52 and/or the lower chamber 54.

The operation of the secondary suspension system 30 and in particular of the blocking system 56 will now be explained in more detail, using the description of a traffic method of the railway vehicle 10.

In a first step, the railway vehicle 10 travels on the rails 32 outside a train station or a station comprising a platform 12.

The jack 36 is then in the retracted configuration, as illustrated in FIG. 2. The second end 46 is mechanically free and the jack 36 is only connected to the car 14 by the knuckle joint 58.

The return spring 55 is in the idle position.

The car 14 and the bogie 16 are connected by the set 34 of springs. The set 34 of springs allows a relative movement between the car 14 and the bogie 16 and thus makes it possible to damp the vertical oscillations between the car 14 and the bogie 16.

The blocking system 56 immobilizes the jack 36 relative to the car 14 in order to avoid the free oscillations of the jack 36 around the knuckle joints 58 and thus to avoid any contact between the jack 36 and the set 34 of springs.

Each blocking spring 72 is in the idle position and keeps the protuberance 70 in contact with the wall 66, as illustrated in FIG. 4.

There is then travel between the first end 44 and the upper part 60 of the cylinder. The power supply device 38 then does not supply the jack 36.

Then, in a second step, the railway vehicle 10 stops at a station along a platform 12.

The height of the lower floor 22 is lower than the height of the platform 12 due to the mass of the car 12 and of the passengers and/or goods present in the inner volume 18.

The upper chamber 52 of the jack 36 is then supplied by the power supply device 38, so as to move the piston 50 downward toward the chassis 28 until the second end 46 comes into contact with the chassis 28.

The pressure exerted by the jack 36 on the chassis 28 then drives the movement of the cylinder 48 along the rod 62, upward, toward the car 12.

The upper cylinder 68 slides along the first end 44 until it cancels out the travel between the first part 44 and the upper part 60 of the cylinder 48.

The protuberance 70 is then no longer in contact with the wall 66 and each blocking spring 72 is in the compressed position.

The jack 36 is then in the deployed configuration.

Then, the jack 36 is supplied by the power supply device 38, so as to move the cylinder 48 along the rod 62 upward.

Thus, the jack 36 moves the car 12 away from the chassis 28 until reaching a predetermined distance between the car 14 and the chassis 28. The predetermined distance between the car 14 and the chassis 28 is for example such that the height from the ground of the floor 22 of the car 14 is substantially equal to the height from the ground of the platform 12, i.e., the floor 22 and the platform 12 extend in a same horizontal plane.

The jack 36 is then powered by the power supply device 38, so as to keep the distance between the chassis 28 and the car 14 constant and prevent the free movement of the set of springs 34.

All throughout the second step, when the jack 36 is deployed, the jack 36 does not undergo transverse forces due to the relative movements of the car 14 and the bogie 16, since the knuckle joints 58 allows the free rotation of the first end 44.

The door 20 is then opened and the passengers and/or goods located in the inner volume 18 can then easily leave or be removed from the railway vehicle 10 through the door 20 in order to be found on the platform 12. Conversely, passengers and/or goods initially located on the platform 12 can enter or be placed in the inner volume 18.

When all of the passengers and/or goods have left and/or entered the inner volume 18, the door 20 is closed again.

The jack 32 is then supplied by the power supply device 38, so as to move the cylinder 48 along the rod 62, downward, toward the chassis 28 until the second end 46 is no longer in contact with the chassis 28.

The return spring 55 then constrains the piston 50 to slide in the cylinder 48, upward, toward the car 14.

The protuberance 70 cooperates with the wall 66 due to the gravity exerted on the jack 36. Each blocking spring 72 is in the idle position and keeps the protuberance 70 against the wall 66. The blocking system 56 therefore immobilizes the jack 36 relative to the car 14.

The first end 44 and the upper part 60 of the cylinder 48 have a travel.

The jack 36 is then in the retracted configuration.

The height of the floor 22 is then lower than the height of the platform 12.

Lastly, in a third step, the railway vehicle 10 starts from the station and the set 34 of springs is free to perform its suspension function between the car 14 and the bogie 16.

Alternatively, the powering of the jack 36 by the power supply device 30 begins before the railway vehicle 10 stops, such that when the railway vehicle 10 stops, the jack 36 is already in the deployed configuration and the floor 22 is already at platform height 12.

Alternatively, the railway vehicle 10 starts from the station once the door 20 closes, the jack 36 returning to the retracted configuration during the beginning of the third step.

The invention claimed is:

1. A railway vehicle comprising at least one car and at least one bogie carrying the car, the bogie comprising a chassis and a secondary suspension system between the chassis and the car, the secondary suspension system, comprising:

a set of springs mounted between the chassis and the car;

a jack comprising two ends extending along a same axis;

a power supply system of the jack; and wherein the jack is configured to go from a first so-called retracted configuration in which the jack is only connected to the car by the first end of the jack, to a second so-called deployed configuration in which the jack is also connected to the chassis by the second end of the jack, the power supply device being configured, in the deployed configuration, to supply the jack so as to move the car away from the chassis or to keep the distance between the car and the chassis constant, the first end of the jack being connected to the car by a knuckle joint-type connection wherein the railway vehicle further comprises a blocking system configured to immobilize the jack relative to the car when the jack is in the retracted configuration and to leave the jack rotatable around the knuckle joint when the jack is in the deployed configuration.

2. The railway vehicle according to claim 1, wherein the blocking system comprises:

an upper cylinder fastened on the upper part of the jack, the first end of the jack being able to slide in the upper cylinder;

at least one converging wall protruding from the car and defining a cavity, the knuckle joint being situated in said cavity;

a protuberance protruding transversely from the upper cylinder and having a shape substantially complementary to the wall, the protuberance being situated in the cavity;

at least one blocking spring situated between the protuberance and the car, each blocking spring being able to go from a first idle position in which the protuberance cooperates with the wall when the jack is in the retracted configuration, to a second compressed position in which the protuberance is separated from the wall when the jack is in the deployed configuration.

3. The railway vehicle according to claim 2, wherein the protuberance has a substantially frustoconical shape.

4. The railway vehicle according to claim 1, wherein the jack comprises a cylinder and a piston separating the cylinder into an upper chamber and a lower chamber, and in that the power supply device of the jack is configured to supply, in the deployed position, only one of the upper and lower chambers in order to move the car away from the chassis or keep the distance between the car and the chassis constant.

5. The railway vehicle according to claim 4, wherein the other of the upper and lower chambers is equipped with a return spring that constrains the jack toward the retracted configuration.

6. The railway vehicle according to claim 1, further comprising a connection arranged between the car and the chassis and configured to limit the separation between the car and the chassis.

7. The railway vehicle according to claim 1, comprising four jacks situated in the four comers of the chassis.

8. A traffic method of a railway vehicle according to claim 1, comprising the following steps:

travel of the railway vehicle, the jack being in the retracted configuration;

stopping of the railway vehicle at a platform, the jack being in the deployed configuration and powered by the power supply device, so as to move the car away from the chassis or to keep the distance between the car and the chassis constant.

* * * * *